US005193701A

United States Patent [19]

Bush et al.

[11] Patent Number: 5,193,701

[45] Date of Patent: Mar. 16, 1993

[54] BOX FOR STORING HANGING FILE FOLDERS

[75] Inventors: Thomas J. Bush, Canton Center, Conn.; Stephen A. Anderson, Murfreesboro, Tenn.

[73] Assignee: Pelikan, Inc., Franklin, Tenn.

[21] Appl. No.: 929,793

[22] Filed: Aug. 13, 1992

[51] Int. Cl.[5] ..... B65D 6/12

[52] U.S. Cl. ..... 220/4.33; 220/7; 229/164; 229/198.3; 206/425

[58] Field of Search ..... 220/4.33, 6, 7, 683, 220/685, 693; 229/127, 126, 164, 198.2, 198.3; 206/425

[56] References Cited

U.S. PATENT DOCUMENTS

| | | | |
|---|---|---|---|
| 2,061,485 | 11/1936 | Scheinman | 229/198.3 |
| 3,246,828 | 4/1966 | Branscum et al. | 229/198.3 |
| 3,614,185 | 10/1971 | Splan . | |
| 3,645,437 | 2/1972 | Giebel et al. . | |
| 3,724,920 | 4/1973 | Beck . | |
| 4,339,069 | 7/1982 | Poteet . | |
| 4,350,257 | 9/1982 | Groth et al. | 220/4.33 |
| 4,427,108 | 1/1984 | Coles et al. | 229/164 |
| 4,447,004 | 5/1984 | House et al. | 229/164 |
| 4,817,861 | 4/1989 | Hendrikson . | |
| 4,969,567 | 11/1990 | Rogers | 220/4.33 |
| 4,998,637 | 3/1991 | Marovskis | 220/4.33 |

*Primary Examiner*—Joseph Man-Fu Moy

*Attorney, Agent, or Firm*—John F. A. Early; John F. A. Early, III

[57] ABSTRACT

A box for storing hanging files, which includes two chipboard sheets which have a plurality of panels that are foldable into a completed double bottom configuration, with vertically extending interlocking corner posts to retain the front, side and rear panels together. The side panels each have a top mounted side rail thereon from which the files are suspended. Each side rail also engages a pair of front and rear corner posts. A top cover panel is hingedly connected to the rear panel of one sheet, with a cover flap hingedly connected to the cover panel. The cover flap is detachably connected to the front panel by loop and pile fastener tabs on the cover flap and the front panel. Handles are provided for lifting and moving the box.

7 Claims, 1 Drawing Sheet

BOX FOR STORING HANGING FILE FOLDERS

BACKGROUND OF THE INVENTION

1. Field of the Invention

This invention relates to file storage boxes of the hanging file folder type.

2. Description of the Prior Art

File folder storage boxes of the type that are designed to store file folders by hanging them from the sides of the box must be capable of providing protection to the stored file folders, must be readily accessible for removal and replacement of the file folders, and must be stackable. Such boxes are intended for long term limited access storage of files.

File storage boxes are subjected to considerable punishment during storage, which is often at a warehouse or storage facility that is remote from the business premises.

The boxes are stacked several units high, which puts considerable weight on the bottom boxes. The boxes may be lifted and dropped, which can cause them to burst or be otherwise damaged.

The weight of the files is concentrated at the end hooks of the file folders, which hooks often rest on channels on top edges of the side panels of the box, or on other suspension devices which also engage the top edges of the side panels of the box, which bear the weight of the files.

It is necessary that the channels adequately support the file folders, and protect the top edges of the side panels of the storage box from damage.

SUMMARY OF THE INVENTION

This invention relates to a box for storing hanging file folders. The box has a double bottom, front, rear and side panels, reinforced corner construction, and a top cover panel which is hinged to the top of the rear panel, with a cover flap which has loop and pile Velcro tabs that may be easily attached and detached to similar tabs on the top portion of the front panel of the storage box to provide protection yet allow ready access to the files.

The storage box has side rails which extend front to back along the tops of the side panels, are each engaged with a side panel, and are each engaged with a pair of vertical corner posts. The side rails have grooved tracks on which the suspension hooks of the file folders are supported, supporting the file folders, and permitting removal and replacement of the file folders as required.

An object of the invention is to provide a box for storing hanging file folders that is of reinforced construction and which provides adequate support for the file folders.

A further object of the invention is to provide a box of the character aforesaid, which may be shipped in knock down condition, but may be readily assembled without tools.

A further object of the invention is to provide a box of the character aforesaid which provides protection and ready access to the contents of the box.

A further object of the invention is to provide a box of the character aforesaid which has two bottom panels.

A further object of the invention is to provide a box of the character aforesaid which is simple and inexpensive to construct but durable and long lasting in use.

A further object of the invention is to provide a box of the character aforesaid which is stackable.

Other objects and advantageous features of the invention will be apparent from the following description and claims.

DESCRIPTION OF THE DRAWINGS

The nature and characteristic features of the invention will be more readily understood from the following description taken in connection with the accompanying drawings forming part hereof in which:

FIG. 2 is an end view in top plan, enlarged, of a corner post of the box of the invention.

Figure 1:
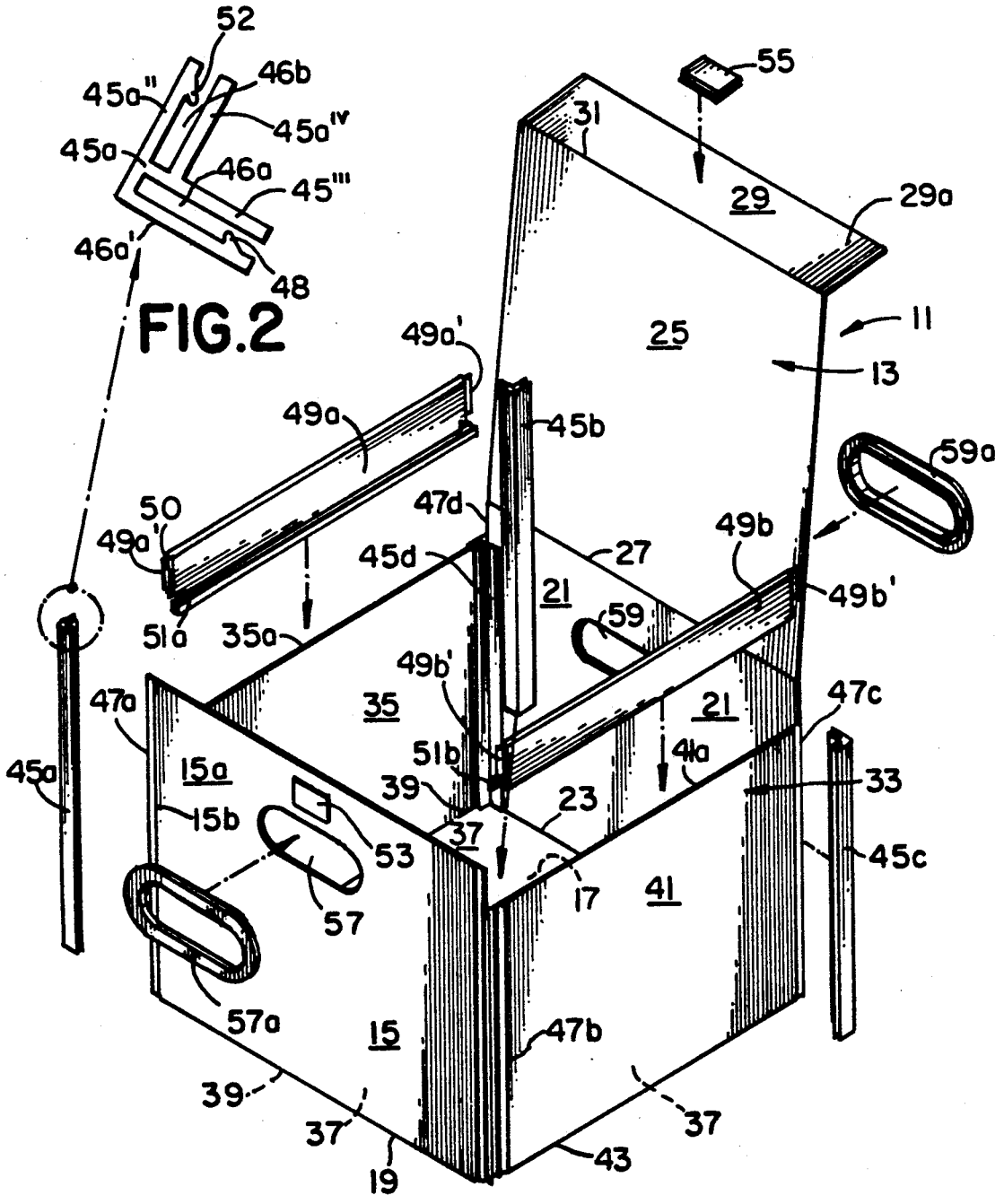
FIG. 1 is a view in perspective, and partially exploded, of the box of the invention.

It should, of course, be understood that the description and drawings herein are illustrative merely and that various modifications and changes may be made in the structure disclosed without departing from the spirit of the invention.

Like numerals refer to like parts throughout the several views.

DESCRIPTION OF THE PREFERRED EMBODIMENT

Referring now more particularly to FIGS. 1 and 2 of the drawings, a box 11 is illustrated for storing hanging file folders.

The box 11, in general, is constructed of two paper covered chipboard panel wall units or sheets.

A first sheet 13 is formed of a plurality of panels that are hingedly connected together. The first sheet 13 has a front panel 15 connected to a bottom panel 17 along a score line 19. Bottom panel 17 has a rear panel 21 connected thereto along a score line 23, and a top cover panel 25 is connected to the top of rear panel 21 along a score line 27. The front of the top cover panel 25 has a cover flap 29 connected thereto along a score line 31, and the cover flap 29 has an inside surface **29*a* with at least one tab 55 thereon of loop or pile material, such as Velcro, or other suitable fastening material. The top portion of front panel 15 has at least one tab 53 thereon of loop or pile material, such as Velcro, or other suitable fastening material, that interacts with tab 55 to detachably secure flap 29** thereto.

First sheet 13 forms the outside of box 11.

Second paper covered chipboard panel wall unit or sheet 33, which with sheet 13 forms the storage box 11, has a side panel 35, with a bottom panel 37 connected thereto along a score line 39.

The bottom panel 37 has another side panel 41 connected thereto along a score line 43.

Bottom panel 37 of sheet 13 is located above the bottom panel 17 of first panel wall sheet 13 when the box 11 is in assembled condition.

The panel 35 is of reduced height relative to the front and rear panels 15 and 21, and has an upper edge **35*a*. A side rail 49*a* is provided, preferably of molded plastic, of generally rectangular shape, and with a recess 50, which is looped over and engaged with the top edge 35*a* of panel 35**.

The side rail **49*a* has a grooved track 51*a* thereon, which extends its length and receives the hooks (not shown) of file folders (not shown) that are hung in the box 11**.

Corner posts **45*a*, 45*b*, 45*c* and 45*d* are provided, preferably of molded synthetic plastic, which retain the upright panels 15, 41, 21 and 35 together at the corners of the storage box 11. The corner posts 45*a*, 45*b*, 45*c*** and 45*d* are of L-shaped configuration in cross section and in top plan as shown in FIG. 2.

Post 45*a*, as shown in FIG. 2, has outer walls $45a^{I}$ and $45a^{II}$ and inside walls $45a^{III}$ and $45a^{IV}$ which are separated from the outer walls to provide slots 46*a* and 46*b*, which respectively engage the vertical edge portions of front panel 15 and side panel 35. The wall $45a^{I}$ has an angularly positioned ridge or internal tooth 48 thereon, extending lengthwise, which engages a vertical score line 15*b* on front panel 15 in assembled condition to hold the box 11 together.

The outer wall $45^{II}$ a has an angularly positioned ridge 52 thereon extending lengthwise which engages a vertical score line on panel 35.

The side rail 49*a* has end tabs $49a^{I}$ one of which is in slot 46*b* and has a groove (not shown), which is engaged by ridge 52.

The corner posts 45*b*, 45*c*, and 45*d* are of like construction as post 45*a* and post 45*b* engages with panels 15, 41, post 45*c* engages with panels 41, 21 and post 45*d* engages with panels 21, 35 to hold the upright panels together.

The side panel 41 is similar to panel 35 and of reduced height relative to panels 15 and 21 and has a top edge 41*a*. The side rail 49*b* has end tabs $49b^{I}$ which are respectively engaged in slots in post 45*b* and in post 45*c*. The tabs 49*b*' have grooves therein (not shown), which engage ridges (not shown) in posts 45*b* and 45*c* similar to post 45*a*.

The front panel 15 has an opening 57 with a molded plastic handle 57*a* seated therein. An opening 59 is also provided in rear panel 21 with a handle 59*a* therein similar to handle 57*a* to be engaged by the hands of the user to facilitate lifting and moving the box 11.

ADVANTAGES

The file folder storage box of the invention is designed to be sold unassembled which has the advantage of saving shelf space in the store where it is sold. Further, this provides a saving to the manufacturer who is saved the steps of assembling the storage box.

The file storage box of this invention is attractive and is affordable. It is provided with a hinged top for easy access to the file folders. It is simple to assemble in minutes, and no tools are required. It is made of solid chipboard with a double bottom for added strength. It is provided with an internal track for hanging the file folders, and is provided with Velcro tabs for a quick, tight closure. Plastic hand-holds are provided for easy carrying, and protective corner guards securely lock the upright panels of the box in place.

We claim:

1. A storage box, of generally rectangular shape with four corners, for storing hanging file folders which comprises:

a first panel wall unit, said first panel wall unit including a front panel and a rear panel, a bottom panel connected to said front and said rear panels along score lines, a top cover panel having a rear portion connected to said rear panel along a crease line, a cover flap connecting a front portion of said top cover panel along a score line, means mounted on said front panel for attaching the front panel to the cover flap, means mounted on said cover flap for attaching the cover flap to the top portion of the front panel, a second panel wall unit in contact with said first unit, said second unit including side panels, and a bottom panel, said side panels connected to said bottom panel along score lines, corner posts engaged between the side panels and said front and rear panels of the corners of the box, said side panels being of reduced height relative to said front and rear panels, said side panels having top edges, side rails engaged with and seated on said top edges, and said side rails having end tabs that are engaged with said corner posts.

2. The storage box as defined in claim 1, wherein said side rails have grooved tracks therein to receive hook means from said file folders for hanging the folders.

3. The storage box as defined in claim 1, wherein said panels are of paper covered chipboard.

4. The storage box as defined in claim 1, in which said corner posts and said side rails are molded synthetic plastic.

5. The storage box as defined in claim 1, said means on said front panel for attaching the front panel to the cover flap being at least one tab of loop and pile material, and said means mounted on the cover flap for attaching the cover flap to the top portion of the front panel being at least one tab of loop and pile material.

6. The storage box of claim 1, said corner posts comprising a first outer and inner wall forming a first vertical slot for receiving a vertical edge portion of a first upright panel, a second outer and inner wall connected at right angles to said first outer and inner wall and forming a second vertical slot for receiving a vertical edge portion of a second upright panel which is at right angles to said first upright panel, said first outer wall having an inside surface, a first angularly positioned ridge extending from the inside surface of said first outer wall for engaging a vertical score line on said first upright panel, said second outer wall having an inside surface, and a second angularly positioned ridge extending from the inside surface of said second outer wall for engaging a vertical score line on said second upright panel.

7. A storage box of generally rectangular shape with four corners for storing hanging file folders which comprises:

a first panel wall unit, said first panel wall unit including a front panel and a rear panel, a bottom panel connected to said front and said rear panels along score lines, a top cover panel having a rear portion connected to said rear panel along a crease line, a cover flap connecting a front portion of said top cover panel along a score line, means mounted on said front panel for attaching the front panel to the cover flap, means mounted on said cover flap for attaching the cover flap to the top portion of the front panel, a second panel wall unit in contact with said first unit, said second unit including side panels, and a bottom panel, said side panels connected to said bottom panel along score lines, corner posts engaged between the side panels and said front and rear panels of the corners of the box, said side panels being of reduced height relative to said front and rear panels, said side panels having top edges, side rails engaged with and seated on said top edges, and said side rails having end tabs that are engaged with said corner posts, said side rails have grooved tracks therein to receive hook means from said file folders for hanging the folders, said panels are of paper covered chipboard, said corner posts and said side rails are molded synthetic plastic, said means on said front panel for attaching the front panel to the cover flap being at least one tab of loop and pile material, and said means mounted on the cover flap for attaching the cover flap to the top portion of the front panel being at least one tab of loop and pile material, said corner posts comprising a first outer and inner wall forming a first vertical slot for receiving a vertical edge portion of a first upright panel, a second outer and inner wall connected at right angles to said first outer and inner wall and forming a second vertical slot for receiving a vertical edge portion of a second upright panel which is at right angles to said first upright panel, said first outer wall having an inside surface, a first angularly positioned ridge extending from the inside surface of said first outer wall for engaging a vertical score line on said first upright panel, said second outer wall having an inside surface, and a second angularly positioned ridge extending from the inside surface of said second outer wall for engaging a vertical score line on said second upright panel.

* * * * *